US005492268A

United States Patent [19]

Biddle et al.

[11] Patent Number: 5,492,268

[45] Date of Patent: Feb. 20, 1996

[54] UPDATABLE INFORMATION FOLDER

[75] Inventors: Patricia K. Biddle; Gary C. Biddle, both of Seattle, Wash.

[73] Assignee: Bidkon Corporation, Seattle, Wash.

[21] Appl. No.: 151,414

[22] Filed: Nov. 12, 1993

[51] Int. Cl.[6] ..... B65D 27/00

[52] U.S. Cl. ..... 229/67.1; 40/159

[58] Field of Search ..... 29/1.5 R; 312/184; 40/159

[56] References Cited

U.S. PATENT DOCUMENTS

| | | | |
|---|---|---|---|
| 910,194 | 1/1909 | Harris | 40/359 |
| 1,076,582 | 10/1913 | Jackson | 40/359 |
| 1,507,433 | 9/1924 | Schaffert | 229/1.5 R |
| 1,529,264 | 3/1925 | Mayers | 40/359 |
| 1,728,574 | 9/1929 | Reese | 40/359 |
| 2,037,579 | 4/1936 | Jonas | 40/359 |
| 2,050,308 | 8/1936 | Gash | 40/359 |
| 4,687,227 | 8/1987 | Kehoe | 229/1.5 R |
| 5,025,978 | 6/1991 | Pacione | 40/359 |

FOREIGN PATENT DOCUMENTS

| | | | |
|---|---|---|---|
| 563390 | 10/1932 | Germany | 312/184 |
| 919859 | 2/1963 | United Kingdom | 312/184 |

*Primary Examiner*—Stephen P. Garbe
*Attorney, Agent, or Firm*—Christensen O'Connor Johnson & Kindness

[57] ABSTRACT

An apparatus and method of conveying, updating, recording, organizing, transporting, storing, and retrieving written information is disclosed. The apparatus includes a series of file folders on a topic, each having temporary and permanent information sections. The temporary information sections are adapted to present and receive temporary information and records. The permanent sections are adapted to present and receive permanent information and records. Each temporary section is removably attached to one of the edges of a permanent information section. When a new update folder in a series is received, the temporary section of the old folder is discarded and the permanent information section of the old folder is retained. In this way, new information can be presented, outdated temporary information can be removed, and permanent information can be retained, preserved, and accessed. The permanent information section is adapted to nest within the update folder between the temporary and permanent information sections of the update folder. In this nested configuration, the tab on the update folder is shifted to the right such that the topic of the series and all version numbers are easily observable by an individual accessing records in a filing cabinet.

7 Claims, 5 Drawing Sheets

UPDATABLE INFORMATION FOLDER

FIELD OF THE INVENTION

This invention relates to information transfer and information record-keeping devices and, more particularly, to file folder devices that are structured in such a way that they convey and update "temporary" information while, at the same time, preserving and maintaining "permanent" information.

BACKGROUND OF THE INVENTION

Information transfer and storage devices and methods come in many forms, some of which are more suitable for certain tasks than others. A need to both update "temporary" information and retain and organize related "permanent" information is a common situation in record keeping. "Temporary" information is that which is useful and relevant only over the short run. "Permanent" information is information that retains its usefulness and relevance indefinitely.

In many fields, changing conditions or rapid technological change generate a need to transfer and update information regarding new technologies, materials, and processes. At the same time, there is the need to retain permanent records indicating which technologies, materials, and processes have been used in the past.

For example, in the medical sciences there is the need to frequently update information regarding new medicines and medical treatments. There also is the need to preserve permanent records indicating which medicines and treatments have been administered in the past. Similarly, in engineering there is the need to update information regarding new production materials, technologies, and processes while retaining permanent records indicating the materials and processes used previously.

There also is the need in many situations to separate temporary and permanent information so that the temporary information can be discarded after its usefulness has ended, and to prevent it from accumulating and interfering with access to intermingled permanent records. This problem is compounded when numerous loose papers are involved. For example, a practicing physician who maintains permanent records on a patient's health history may also wish to attach temporary information such as upcoming office appointments, outstanding bills, and notes for creating dictated correspondence. Unless this temporary information were removed, it could quickly build up and bury important permanent information and other germane temporary information. Providing for quick reference to permanent written records, portability of records, and ease of recording also are problematical.

These problems are faced by many interests and professions that experience situational or technological change, and that employ "hard copy" primed and written records.

SUMMARY OF THE INVENTION

The file folders of the present invention and their method of use were developed to meet the need to transfer and update temporary information while at the same time preserving, organizing, maintaining, and accessing permanent information. It is implemented in such a way as to be quick and easy to use, easy to understand, portable, and to provide a convenient writing space for creating new records. An integrated update and tabbing system provides for the updating of temporary information and ensures that the information topic and latest update version are readily observable.

The present invention solves the record-keeping problems described above by providing an apparatus and method for conveying and updating temporary information while preserving permanent information. The apparatus includes a first folder and a second folder. The first folder includes a first permanent information section adapted to receive permanent records. The first permanent information section has at least four edges. The first folder also includes a first temporary information section removably attached to one of the edges of the first permanent information section. The second folder includes a second permanent information section and a second temporary information section. The second permanent information section is adapted to receive permanent records and has at least four edges. The second temporary information section is removably attached to one of the edges of the second permanent information section. The first permanent information section of the first folder is adapted to nest within the second folder between the second permanent information section and the second temporary information section after removal of the first temporary information section from the first folder.

Preferably, the first permanent information section of the first folder includes a first tab on its edge opposite the edge attached to the first temporary information section. The second permanent information section of the second folder also includes a second tab on its edge opposite the edge attached to the second temporary information section. The second tab is shifted relative to the first tab such that at least a portion of each tab is visible when the first permanent information section is nested within the second folder.

Also in the preferred embodiment of the invention, the first and second permanent information sections each include a front face and means for removable attachment of papers to the front face.

As another aspect of the preferred embodiment of the invention, the first permanent information section includes a first permanent fold-out section attached to the edge of the first permanent information section opposite the edge attached to the first temporary information section. The first permanent fold-out section is adapted to be folded against the first permanent information section about the attachment between the first permanent information section and the first permanent fold-out section. The first temporary information section also includes a first temporary fold-out section attached to the edge of the first temporary information section opposite the edge attached to the first permanent information section. The first temporary fold-out section is adapted to be folded against the first temporary information section about the attachment between the first temporary information section and the first permanent fold-out section. Preferably, the second folder also includes similar fold-out sections attached to the second permanent information section and the second temporary information section.

The invention also includes a method for storing information within a plurality of folders including permanent sections and temporary sections. The method includes the steps of adding permanent and temporary data to a first folder on the permanent and temporary sections, respectively, removing the temporary section from the first folder, and inserting the permanent section of the first folder between the permanent and temporary sections of a second folder. Preferably, the method also includes the steps of removing the temporary section from the second folder and inserting the permanent sections of the first and second folders between the permanent and temporary sections of a third folder.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
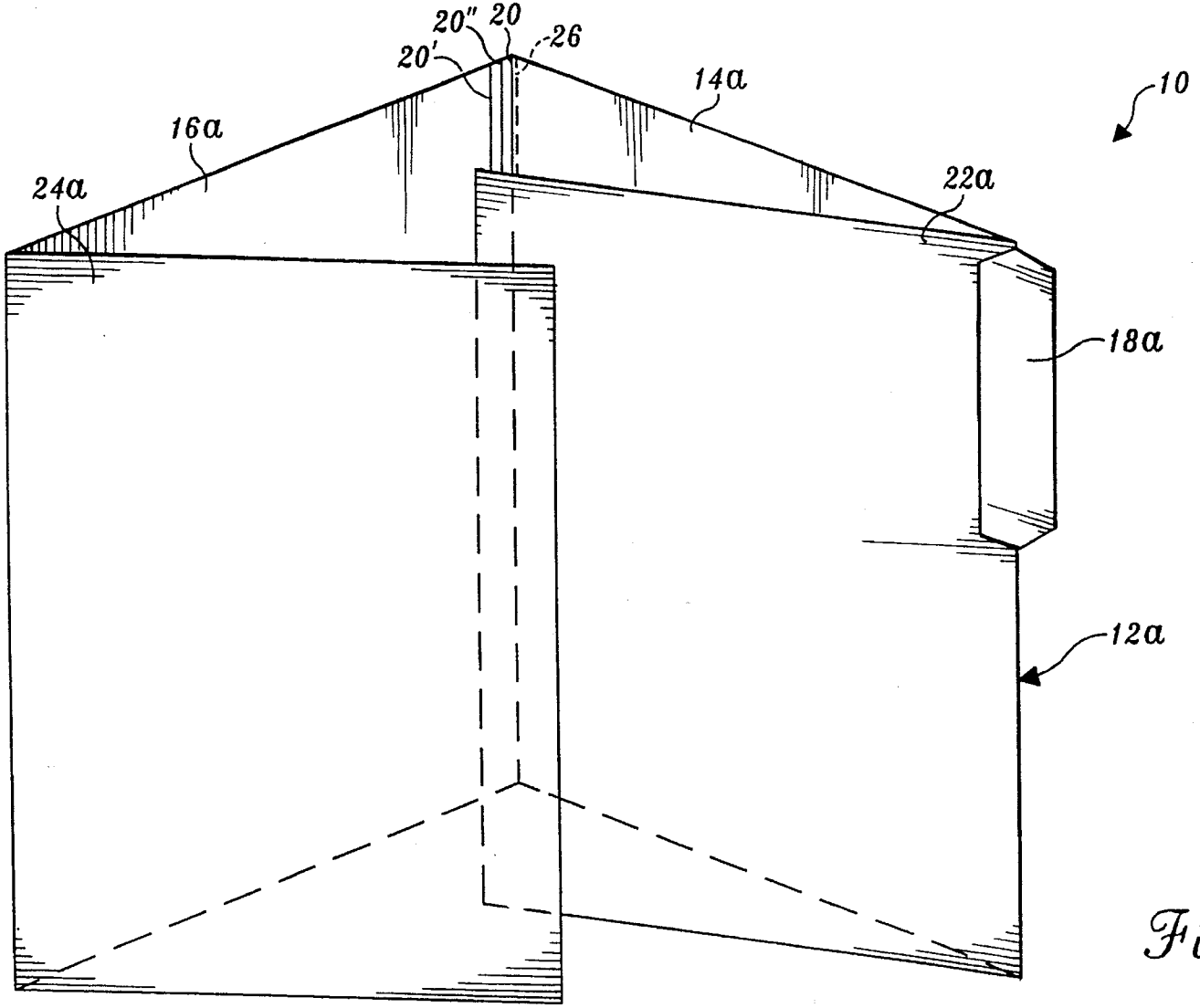
FIG. 1 is an isometric view illustrating a preferred embodiment of one of the folders of the present invention with temporary and permanent information sections and optional fold-out panels.

The preferred embodiments of the information storage device 10 of the present invention provide an apparatus and method of use for conveying and updating temporary information while preserving permanent information. The apparatus consists of a series of folders 12 that provide designated spaces for presenting, recording, and attaching temporary and permanent information, plus an updating and tabbing system that allows information to be organized and accessible by type of information. Note that reference characters within this description that do not include letters, e.g., 12, should be interpreted as applying to all corresponding reference characters in the drawings that do not include reference letters, e.g., 12*a*, 12*b*, 12*c*, 12*d*.

Each folder 12 has two major sections. A temporary information section 16 is adapted to convey and update temporary information. A permanent information section 14 is adapted to record, organize, and preserve permanent information. Temporary information section 16 is the portion of folder 12 preceding a center fold line 20. Permanent information section 14 is the portion of folder 12 following center fold line 20. Updatability is provided via a perforation line 26 between temporary and permanent information sections 16 and 14 of each folder 12 and a tab shift conventionally applied to each subsequent folder 12 in a series.

Updating of information in an old folder 12 occurs when a new folder 12 in the series is received by the user. Updating is accomplished by separating the old folder 12 along perforation line 26 between temporary and permanent information sections 16 and 14, and discarding outdated temporary information contained in temporary information section 16. The old permanent information section 14 is retained, and inserted into new folder 12. A tab 18 on new folder 12 is shifted (to the right) to reveal a new update version number beyond the edge of old tab 18.

Thus, the update and tabbing system embodied in this invention provides for the creation, organization, and retention of permanent information and records by allowing them to nest inside an update folder 12 that conveys new temporary information and that provides for the creation and retention of new temporary and permanent records. This process of updating temporary information while preserving permanent information can continue indefinitely by utilizing new update folders in a topic series. This invention also provides spaces for recording new information and a steady writing surface, plus easily accessed storage and portability for records.

Referring specifically to FIG. 1, the information transfer and storage device 10 of the present invention is illustrated. Temporary information section 16*a* is shown to the left of the center fold line 20*a*. Permanent information section 14*a* is shown to the fight of the center fold line 20*a*. Temporary information section 16*a* is adapted to present preprinted temporary information, to record new temporary information, and to attach temporary records. Permanent information section 14*a* is adapted to present preprinted permanent information, to record new permanent information, and to attach permanent records. Between temporary and permanent information sections 16*a* and 14*a*, just to the right of center fold line 20*a*, is a perforation line 26*a* for separating temporary and permanent information sections 16*a* and 14*a* of information device 10 during updating. Perforation line 26*a* is located slightly to the right of the center fold line 20*a* to permit permanent information section 14*a* of first folder 12*a* in a series to nest inside second folder 12*b* in such a way that the outer edges of each are aligned evenly. Fold lines 21*a* and 21*a*' are indentations that parallel center fold line 20*a* to provide for expandability, depending on the thickness of the contents of folder 12*a*.

FIG. 1 also illustrates a preferred embodiment of the present invention that includes an optional fold-out panel 24*a* for temporary information and an optional fold-out panel 22*a* for permanent information. Optional fold-out panel 24*a* is used in conjunction with temporary information panel 16*a* for presenting, recording, and attaching additional temporary information. Optional fold-out panel 24*a* attaches to the outer edge of temporary information panel 16*a*, opposite the attachment of panel 16*a* to permanent information section 14*a* along center fold line 20*a*. Optional fold-out panel 24*a* folds inwardly for transport and storage. The width of optional fold-out panel 24*a* is less than the width of temporary information panel 16*a*, so that optional panel 24*a* does not interfere with the employment of expansion fold 21*a*.

Optional fold-out panel 22*a* is used in conjunction with permanent information section 14*a* for presenting, recording, and attaching additional permanent information. Optional fold-out panel 22*a* attaches to the outer edge of permanent information section 14*a*, opposite the attachment of temporary information section 14*a* to permanent information section 16*a* along center fold line 20*a*. Optional fold-out panel 22*a* folds inwardly for transport and storage. The width of optional fold-out panel 22*a* is slightly less than that of permanent information section 14*a* such that, when it is folded in for storage, its inner edge is even with perforation line 26*a*. This allows permanent information section 14*a* containing optional fold-out panel 22*a* to nest inside second folder 12*b* such that its outer edge aligns evenly with second permanent information section 14*b*. In the embodiment shown in FIG. 1, tab 18*a* is formed as a cutout from optional fold-out panel 22*a*. Tab 18*a* is not folded inwardly with panel 22*a*, such that it projects outwardly within the plane of permanent information section 14*a*. Depending on the application to which it is applied, information transfer and storage device 10 may contain one, both, or additional optional fold-out panels 24*a* and 22*a* to provide additional space for presenting, recording, attaching, and storing temporary and/or permanent information.

Information transfer and storage device 10 is preferably constructed of card stock material to provide durability and a steady writing surface for recording new information. Other materials, such as heavier or lighter weight paper or plastic materials could alternatively be used. The sections and panels 16*a*, 14*a*, 24*a*, and 22*a* are rectangular in shape and of a size suitable for the filing of records of any particular intended use.

Figure 2:
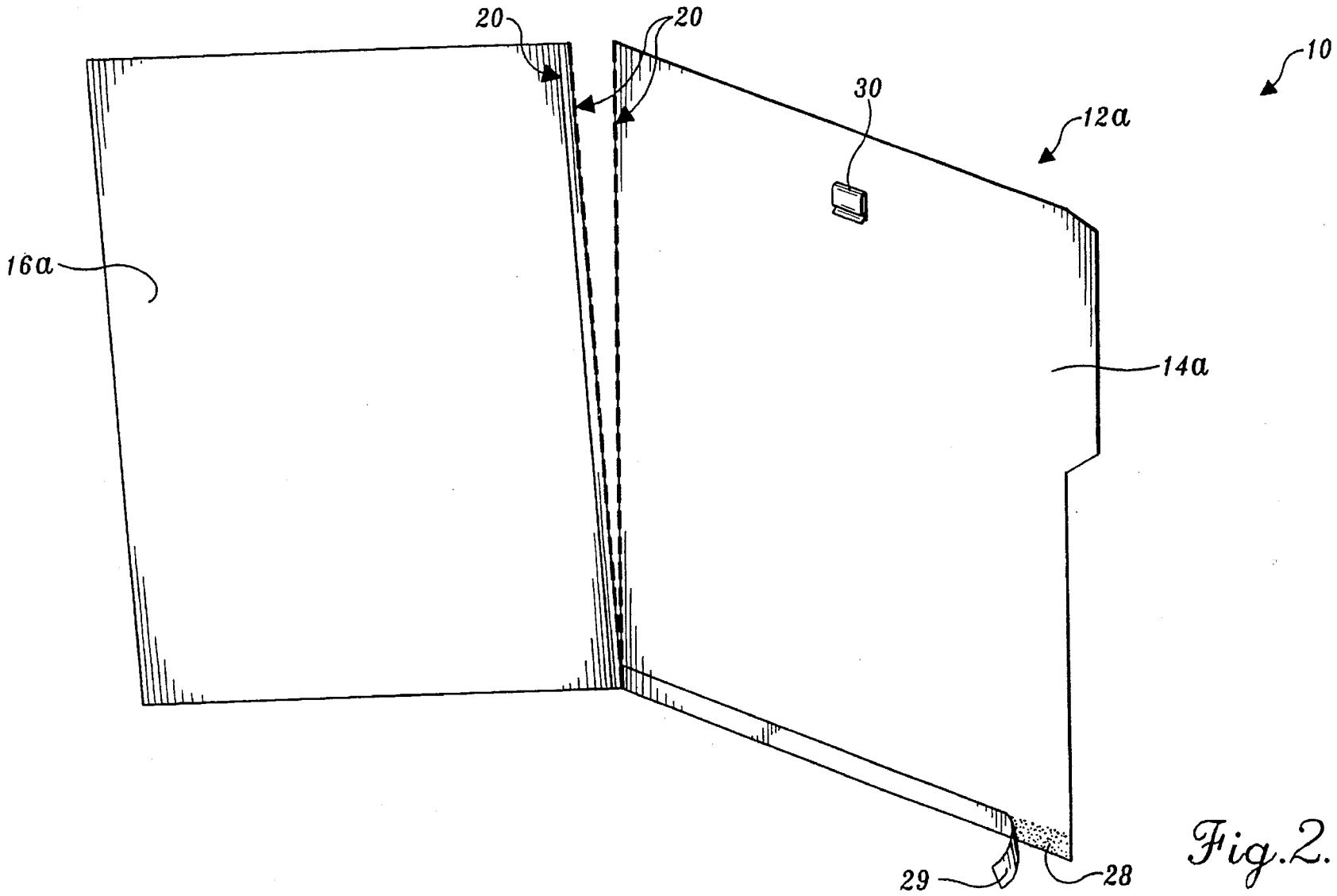
FIG. 2 is an isometric view of a preferred embodiment of one of the folders of the present invention, illustrating the removal of the temporary information section.
Figure 3:
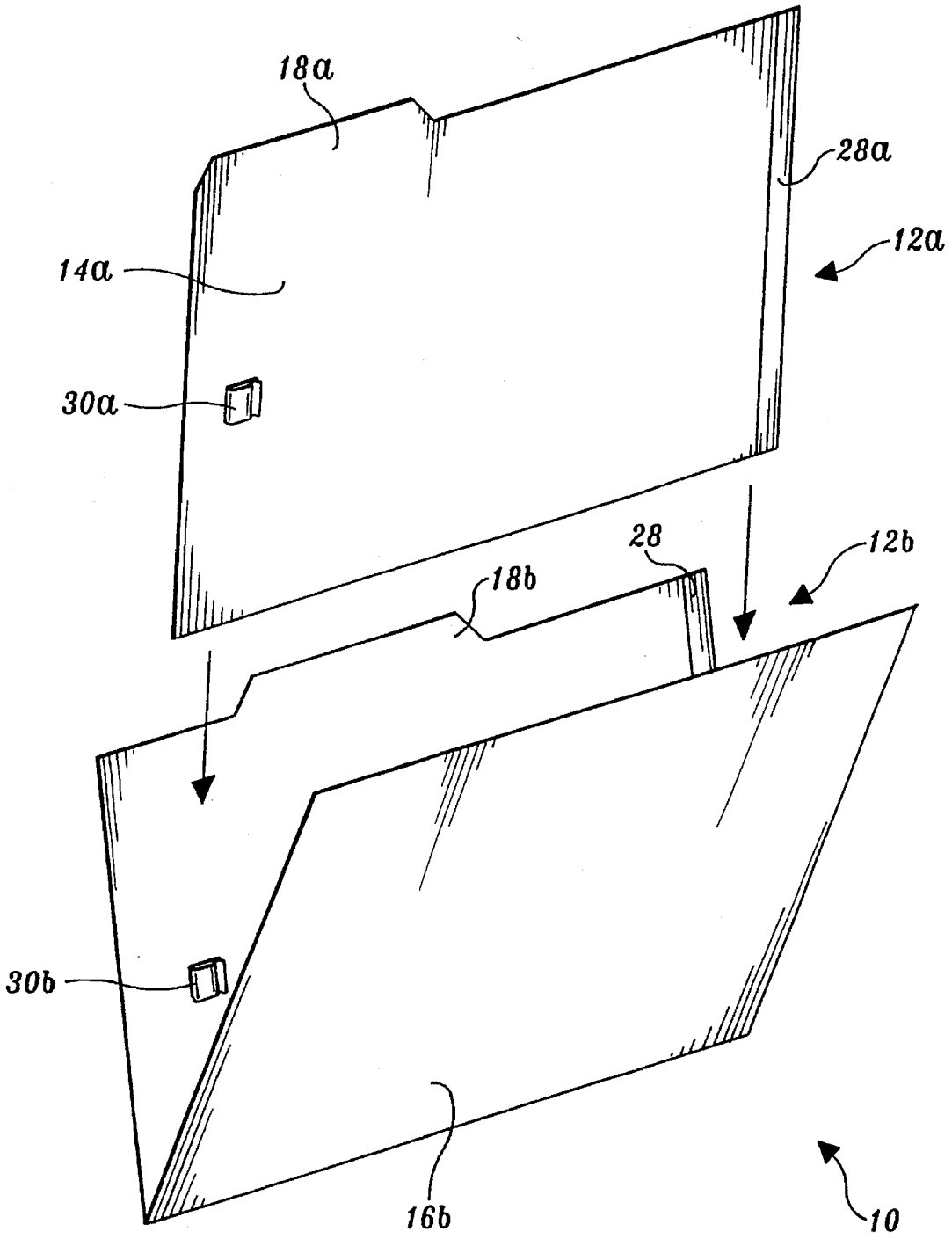
FIG. 3 is an isometric view illustrating the insertion of a permanent information section of an older folder into an update folder in the topic series.

FIG. 2 illustrates the first step in the updating process. Shown is first folder 12*a* in an embodiment of the present invention that, for clarity of presentation, omits optional fold-out panels 22*a* and 24*a*. When a second folder 12*b* of the current topic series is received (as shown in FIG. 3), temporary information section 16*a* of first folder 12*a* is separated from permanent information section 14*a* of first folder 12*a* along perforation line 26*a*. Those familiar with the art will also appreciate that perforation line 26*a* could be in the form of a dotted line or other marking indicating where to cut to separate the temporary and permanent information sections of first folder 12*a*. Once temporary and permanent information sections 16*a* and 14*a* are separated, temporary information section 16*a* of first folder 12*a*, optional fold-out panel 24*a*, and attached outdated temporary records are discarded. Permanent information section 14*a* of first folder 12*a* and any attached permanent information records are retained for insertion into second folder 12*b*, as illustrated in FIG. 3 below.

FIG. 2 also illustrates means of attaching records to folder 10 of the present invention. Shown on permanent information section 14*a* is a clip 30*a* for securing loose papers. As presented, clip 30*a* is a U-shaped spring with one side fastened to the upper middle portion of permanent information section 14*a*, such that the free ends of clip 30*a* are biased together. Loose papers are placed between the free ends of clip 30*a* and held in place by the biasing force of the clip 30*a*. Along the bottom edge of permanent information section 14*a* is an adhesive strip 28*a*. Adhesive strip 28*a* includes an adhesive and a peel-away strip 29*a* to expose the adhesive. Adhesive strip 28*a* could alternatively be placed along another edge of a panel or in another position convenient for attaching records or continuation pages. Documents and records also could be attached using staples, two-prong clips, or other clips or devices, and could appear on any of the panels included in an embodiment of the present invention.

The position of tab 18*a* in FIG. 2 designates the first folder in a topic series. Tab 18*a* is located in a topmost position on the outside edge of permanent information section 14*a* of folder 12*a*. In this embodiment, tabs 18 on successive folders 12 in the topic series will be shifted downward to allow the new version number to be seen after permanent information section 14*a* of first folder 12*a* depicted in FIG. 2 is inserted into second folder 12*b*. Alternatively, it will be appreciated that tabs 18 could run along any edge of folders 12 beginning from one side or the other, such that a portion of tab 18 on each successive folder 12 in a topic series extends beyond the tab 18 of the previous folder 12 in the series to simultaneously reveal the folder topic, the latest version number, and all previous version numbers in the series.

FIG. 3 illustrates the second step of the updating process. Second folder 12*b* in a topic series has been received. It contains a new temporary information section 16*b* containing updated information on the topic, and a new permanent information section 14*b* for recording and attaching new permanent records. Permanent information section 14*a* of first folder 12*a* is preserved and maintained by inserting it between temporary information section 16*b* and permanent information section 14*b* of second folder 12*b*. Tab 18*b* on second folder 12*b* is positioned to the right of tab 18*a* on first folder 12*a*. This rightward shift of tab 18*b* allows the version number of second folder 12*b* to be visible on tab 18*b* beyond the right edge of tab 18*a* when permanent information section 14*a* is nested inside of second folder 12*b* and when viewed from the front. Also visible will be the topic title of the series and the previous version number of first folder 12*a*.

It will be appreciated that this updating process can continue indefinitely. Thus, when the third folder in the series 12*c* (shown in FIG. 4) is received, temporary section 16*b* of second folder 12*b* will be separated from permanent information section 14*b* of second folder 12*b* along second perforation 26*b* and discarded, thereby purging files of outdated temporary information. Permanent information section 14*b* of second folder 12*b* will be retained and, together with permanent information section 14*a* of first folder 12*a*, will be inserted between the temporary and permanent information sections of folder 12*c*. Tabs 18*a–c* successively shift rightward such that the version numbers of all folders 12 in the series are visible, and such that the most recent version number appears on the rightmost tab, making it easy to determine whether the most recent update in a series has been received. When tabs in a series reach the right edge of the last folder in a series, they will begin again from the left under a new series designation. This ensures the visibility of tabs and limits the volume of records that need to be contained in a given folder.

Figure 4:
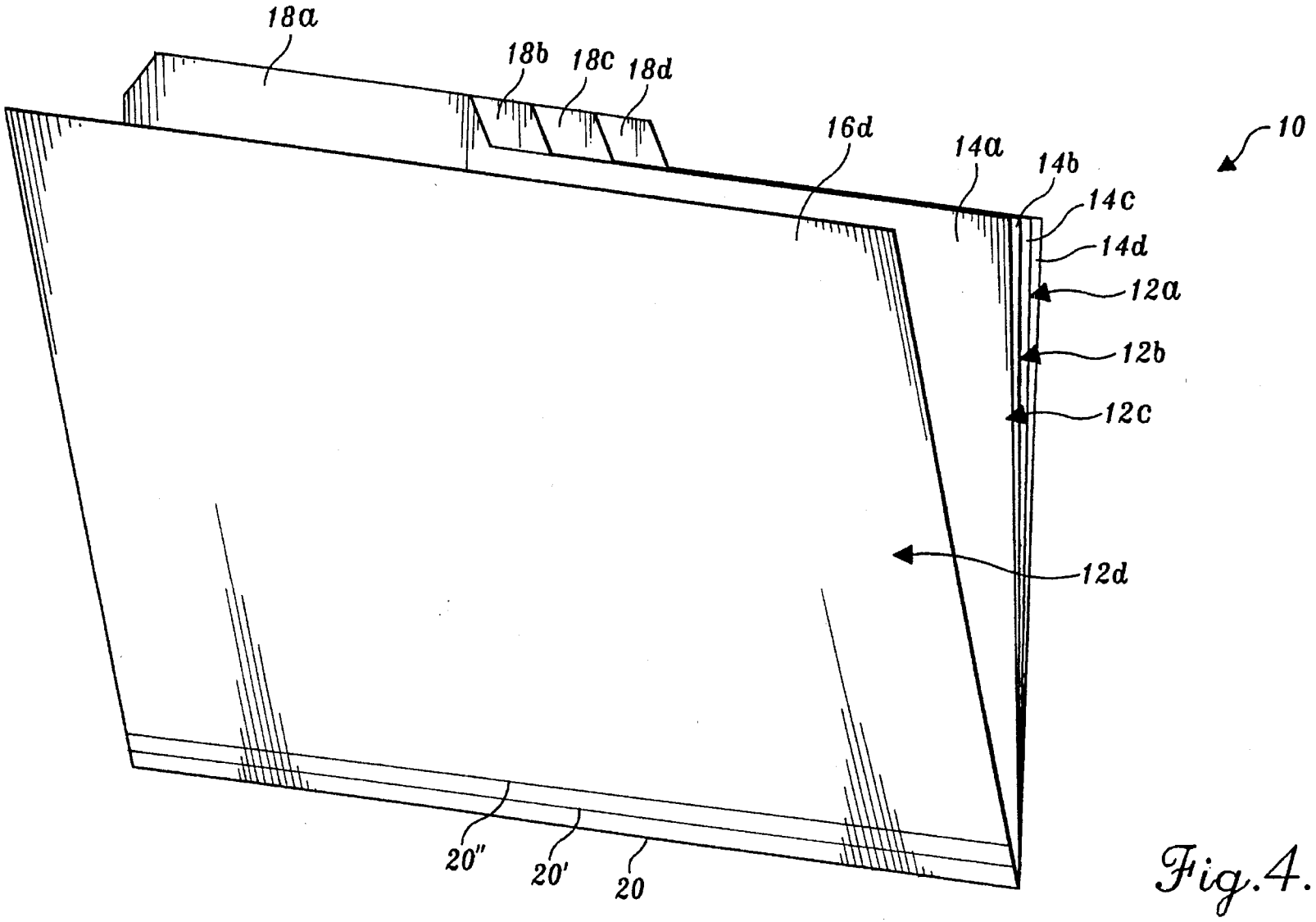
FIG. 4 is an isometric view illustrating the permanent sections of three older folders nested inside a new folder in the series.

Referring now to FIG. 4, utility of the combination of the series of folders 12 for storing and accessing information will now be described in more detail. The newest folder 12*d* in a topic series presents the latest update information on the topic in its temporary information section 16*d*, as well as places to record and attach new temporary information. New folder 12*d* also provides for the creation and retention of new permanent information in its permanent information section 14*d*. Between its temporary and permanent information sections, new folder 12*d* provides for the retention and organization of the permanent information sections of previous folders 12*a*, 12*b*, and 12*c*, in the topic series. The tabbing system embodied in the present invention is illustrated by tabs 18*a*, 18*b*, 18*c*, and 18*d*, which are attached to the permanent information sections 14 of folders 12*a*, 12*b*, 12*c*, and 12*d* in the topic series, respectively. The tab of each successive folder 12 in the series is shifted to the right to reveal its version number. Thus, the update and tabbing system embodied in the present invention ensures that the topic of a series, and all version numbers of folders in the topic series, are easily visible and readable from the front, when viewed by an individual accessing records stored in a filing cabinet. In this way, records relating to any version number can be accessed quickly and easily.

Figure 5A:
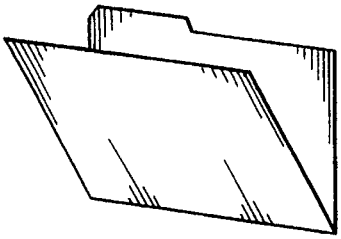
FIGS. 5A–5G are isometric views illustrating the preferred sequence of use of the folder of the present invention, the older permanent sections of the folders being nested within new folders having both permanent and temporary information sections.

An example of the progression of the process of information storage and updating with the folders of the present invention is illustrated in FIGS. 5A through 5G. As shown in FIG. 5A, folder 12*a* is first used to store and convey information on both its permanent and temporary information sections 14*a* and 16*a*, respectively.

Figure 5B:
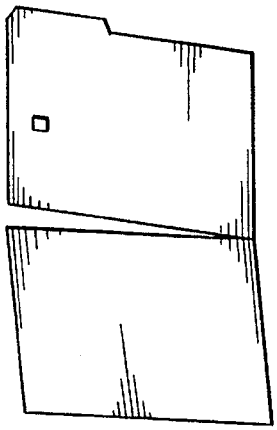

Once temporary information section 16*a* is either outdated or sufficiently full or permanent information portion is full (additional material can be added to clip 30 or on optional temporary or permanent fold-outs 24*a* or 22*a* such as that shown in FIG. 1 ) it can be removed as illustrated in FIG. 5B. Temporary information section 16*a* is preferably removed by tearing it from permanent information section 14*a* along score line 26.

Figure 5C:
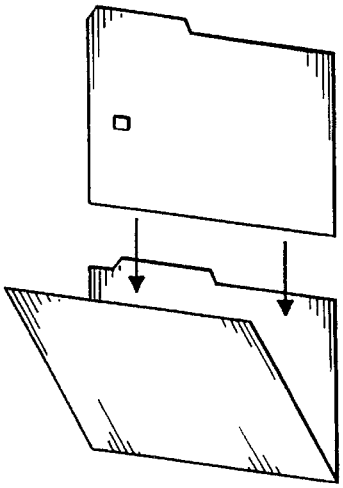
Figure 5D:
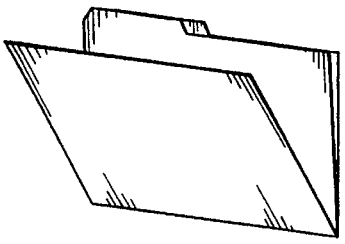

In FIG. 5C permanent information section 14*a* is then placed within second folder 12*b* between second permanent information section 14*b* and second temporary information section 16*b*. Permanent and temporary information can then be added to second permanent and temporary information sections 14*b* and 16*b*, respectively, while conveniently retaining the permanent information from first permanent information section 14*a*. Note in FIG. 5D that once first and second folders 12*a* and 12*b* are nested together, second tab 18*b* is shifted relative to first tab 18*a* so that at least a portion of each is visible.

Figure 5E:
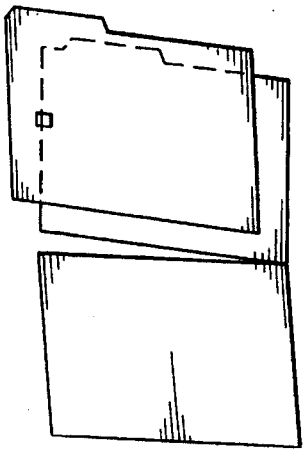
Figure 5F:
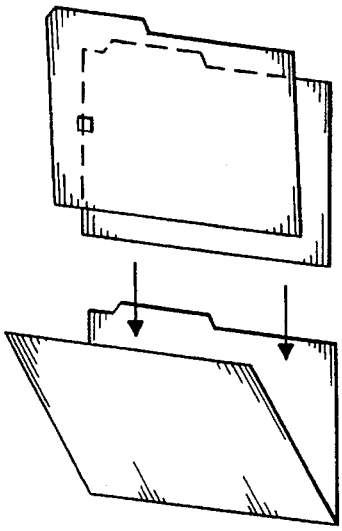
Figure 5G:
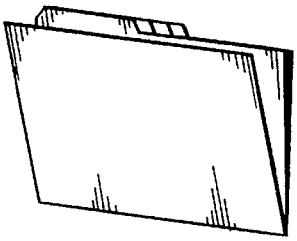

Referring to FIGS. 5E through 5G, the process continues as second temporary information section 16*b* is removed, and first and second permanent information sections 14*a* and 14*b* are nested within third folder 12*c* in the same manner as explained above. The folders of the present invention allow this process to continue easily and without confusion to four, five, or even more folders. Thus information can continually be stored, conveyed, and updated in an organized accessible fashion.

The advantages of the above-described updatable information folder are numerous. Temporary and permanent information and records can be created, organized, recorded, and accessed quickly and easily. Information printed and recorded on the information folder can be read easily at a glance. Information can be easily updated, and outdated temporary information can be easily separated and removed so as to not interfere with access to permanent records. The folder serves the purpose of a file folder for transporting, organizing, and storing loose documents, and it provides a stable writing surface for recording new information.

Updating the folder is easy as the permanent information is segregated from the temporary information when initially placed in folder 12. The permanent information from a previous folder is easily transferable to a new folder without the outdated temporary information. Tabs 18 allow the folder title and all previous version numbers to be seen in sequential order, with the latest version on the right or lowest tab 18. Folders 12 are preferably sized to fit in a standard file cabinet.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for storing permanent and temporary information, the apparatus comprising:

(a) first folder including a first permanent information section adapted to receive permanent records, the first permanent information section having a first edge, and a first temporary information section removably attached to the first edge of the first permanent information section, wherein the first permanent information section of the first folder includes a first tab on its edge opposite the edge attached to the first temporary information section; and (b) a second folder including a second permanent information section adapted to receive permanent records, the second permanent information section having a second edge, and a second temporary information section removably attached to the second edge of the second permanent information section, the first permanent information section of the first folder being adapted to nest within the second folder between the second permanent information section and the second temporary information section, wherein the second permanent information section of the second folder includes a second tab on its edge opposite the edge attached to the second temporary information section, the second tab being shifted relative to the first tab when the folder is nested within the second folder such that at least a portion of each tab is visible when the first permanent information section is nested within the second folder, and wherein the first and second permanent information sections each include a first face and means for removable attachment of papers to the first face.

2. The apparatus of claim 1, wherein the first permanent information portion includes a first permanent fold-out portion attached to the edge of the first permanent information portion opposite the edge attached to the first temporary information portion, the first permanent fold-out portion being adapted to be folded against the first permanent information portion about the attachment between the first permanent information portion and the first permanent fold-out portion.

3. The apparatus of claim 1, wherein the first temporary information portion includes a first temporary fold-out portion attached to the edge of the first temporary information portion opposite the edge attached to the first permanent information portion, the first temporary fold-out portion adapted to be folded against the first temporary information portion about the attachment between the first temporary information portion and the first permanent fold-out portion.

4. An apparatus for storing permanent and temporary information, the apparatus comprising:

(a) a first folder including a first permanent information section adapted to receive permanent records, the first permanent information section having a first edge, and a first temporary information section removably attached to the first edge of the first permanent information section, wherein the first permanent information section of the first folder includes a first tab on its edge opposite the edge attached to the first temporary information section and a first permanent fold-out section attached to the edge of the first permanent information section opposite the edge attached to the first temporary information section, the first permanent fold-out section being adapted to be folded against the first permanent information section about the attachment between the first permanent information section and the first permanent fold-out section, and wherein the first temporary information section includes a first temporary fold-out section attached to the edge of the first temporary information section opposite the edge attached to the first permanent information section, the first temporary fold-out section being adapted to be folded against the first temporary information section about the attachment between the first temporary information section and the first permanent fold-out section; and (b) a second folder including a second permanent information section adapted to receive permanent records, the second permanent information section having a second edge, and a second temporary information section removably attached to the second edge of the second permanent information section, the first permanent information section of the first folder being adapted to nest within the second folder between the second permanent information section and the second temporary information section, wherein the second permanent information section of the second folder includes a second tab on its edge opposite the edge attached to the second temporary information section, the second tab being shifted relative to the first tab when the folder is nested within the second folder such that at least a portion of each tab is visible when the first permanent information section is nested within the second folder.

5. The apparatus of claim 4, wherein the second permanent information section includes a second permanent fold-out section attached to the edge of the second permanent information section opposite the edge attached to the second temporary information section, the second permanent fold-out section being adapted to be folded against the second permanent information section about the attachment between the second permanent information section and the second permanent fold-out section, and wherein the second temporary information section includes a second temporary fold-out section attached to the edge of the second temporary information section opposite the edge attached to the second permanent information section, the second temporary fold-out section being adapted to be folded against the second temporary information section about the attachment between the second temporary information section and the second permanent fold-out section.

6. A method for storing and updating information comprising the steps of:

(a) providing a plurality of folders including permanent sections and temporary sections, the permanent sections having tabs;

(b) adding permanent and temporary data to a first folder on the permanent and temporary sections, respectively;

(c) removing the temporary section from the first folder; and (d) inserting the permanent section of the first folder between the permanent and temporary sections of a second folder, with a tab convention that reveals the latest version.

7. The method of claim 6, further comprising the steps of removing the temporary section from the second folder and inserting the permanent sections of the first and second folders between the permanent and temporary sections of a third folder.

* * * * *